US007372457B2

(12) United States Patent
Wang

(10) Patent No.: US 7,372,457 B2
(45) Date of Patent: May 13, 2008

(54) METHOD FOR ADJUSTING RESOLUTION AND REFRESH RATE OF DISPLAY MONITOR OF COMPUTER SYSTEM

(75) Inventor: Jian-Feng Wang, Shenzhen (CN)

(73) Assignees: Hong Fu Jin Precision Industry (Shenzhen) Co., Ltd., Bao-an District, Shenzhen, Guangdon Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 604 days.

(21) Appl. No.: 11/082,100

(22) Filed: Mar. 16, 2005

(65) Prior Publication Data

US 2006/0092187 A1 May 4, 2006

(30) Foreign Application Priority Data

Oct. 29, 2004 (TW) ..... 93132959 A

(51) Int. Cl.
*G09G 5/00* (2006.01)

(52) U.S. Cl. ..... 345/204; 345/698

(58) Field of Classification Search ..... 345/204, 345/690, 698, 699, 214, 1.1, 1.3; 710/1, 710/63, 69, 70; 348/177
See application file for complete search history.

(56) References Cited

U.S. PATENT DOCUMENTS 5,473,342 A * 12/1995 Tse et al. ..... 345/600
6,037,919 A 3/2000 Hanson
6,049,316 A * 4/2000 Nolan et al. ..... 345/698
6,054,980 A 4/2000 Eglit
6,278,433 B2 * 8/2001 Narui ..... 345/581
2003/0169244 A1 * 9/2003 Kurokawa et al ..... 345/204
2004/0046707 A1 * 3/2004 Mori et al. ..... 345/1.1
2004/0150581 A1 * 8/2004 Westerinen et al. ..... 345/1.3
2004/0230705 A1 * 11/2004 Maciesowicz ..... 710/1
2004/0233188 A1 * 11/2004 Anderson ..... 345/204
2005/0275642 A1 * 12/2005 Aufranc et al. ..... 345/204
2006/0143679 A1 * 6/2006 Yamada et al. ..... 725/131

* cited by examiner

*Primary Examiner*—Nitin I. Patel
(74) *Attorney, Agent, or Firm*—Morris Manning Martin LLP; Tim Tingkang Xia, Esq.

(57) ABSTRACT

A method for adjusting a resolution and refresh rate of a display monitor (2) of a computer system includes the steps of: providing a portable recording device (3) recording an auto-run application; connecting the portable recording device to a computer (1); generating a matching resolution and refresh rate of the display monitor; and adjusting the current resolution and refresh rate of the computer system to the matching resolution and refresh rate. The portable recording device can be a floppy disk, a compact disk, or a USB (Universal Serial Bus) recorder.

9 Claims, 4 Drawing Sheets

| | Byte | Bit | Description |
|---|---|---|---|
| 35th Byte | 1 | 7 | 720x400@70Hz |
| | | 6 | 720x400@88Hz |
| | | 5 | 640x480@60Hz |
| | | 4 | 640x480@67Hz |
| | | 3 | 640x480@72Hz |
| | | 2 | 640x480@75Hz |
| | | 1 | 800x600@56Hz |
| | | 0 | 800x600@60Hz |
| 36th Byte | 1 | 7 | 800x600@72Hz |
| | | 6 | 800x600@75Hz |
| | | 5 | 832x624@75Hz |
| | | 4 | 1024x768@87Hz |
| | | 3 | 1024x768@60Hz |
| | | 2 | 1024x768@70Hz |
| | | 1 | 1024x768@75Hz |
| | | 0 | 1280x1024@75Hz |

| | Byte | Bit | Description |
|---|---|---|---|
| 35th Byte | 1 | 7 | 720x400@70Hz |
| | | 6 | 720x400@88Hz |
| | | 5 | 640x480@60Hz |
| | | 4 | 640x480@67Hz |
| | | 3 | 640x480@72Hz |
| | | 2 | 640x480@75Hz |
| | | 1 | 800x600@56Hz |
| | | 0 | 800x600@60Hz |
| 36th Byte | 1 | 7 | 800x600@72Hz |
| | | 6 | 800x600@75Hz |
| | | 5 | 832x624@75Hz |
| | | 4 | 1024x768@87Hz |
| | | 3 | 1024x768@60Hz |
| | | 2 | 1024x768@70Hz |
| | | 1 | 1024x768@75Hz |
| | | 0 | 1280x1024@75Hz |

Fig. 2

METHOD FOR ADJUSTING RESOLUTION AND REFRESH RATE OF DISPLAY MONITOR OF COMPUTER SYSTEM

BACKGROUND OF THE INVENTION

1. Field of the Invention

The present invention is related to methods for adjusting resolution and refresh rate of display monitors of computer systems.

2. Prior Art

Different display monitors can operate according to different configurations. For example, the CRT (Cathode-Ray Tube) monitor for a research engineer or a corporate manager is often a new, expensive monitor with a high resolution and a high refresh rate (e.g. 85 Hz or more). In contrast, the CRT monitor for a low-level clerk or assistant is often an old, inexpensive legacy monitor with a low resolution and a low refresh rate (e.g. 60 Hz). The newer monitors support a higher refresh rate which reduces flicker, while older monitors must be refreshed at a lower rate to avoid damage to the monitor. LCD (Liquid Crystal Display) monitors have rapidly progressed to now enjoy widespread use around the world as the display apparatus of choice for PCs (Personal Computers) and other electronic equipment. An LCD produces an image on a liquid crystal surface of an LCD panel thereof by uniformly illuminating the entire liquid crystal surface area with a backlight. The backlight is a surface light source disposed behind the LCD panel. Most LCD monitors can operate with a low refresh rate (e.g. 60 Hz) without flicker, and can therefore help prevent eyestrain.

PC systems that include a monitor are set with appropriate default display configurations before sale. However, many "DIYers" ("do-it-yourselfers") like to handpick an individual monitor to buy, either at the time they buy a PC or after they have bought a computer system. The monitor may be an old CRT monitor or an LCD monitor. In such case, if the computer system is set with a resolution and refresh rate exceeding what the CRT or LCD monitor supports, when the monitor is connected with the computer the monitor does not work or its circuitry is liable to be damaged. When this happens, a common solution adopted is to find another monitor supporting a higher resolution and refresh rate, connect the other monitor with the PC, go through the menus in a Windows control panel to manually reset the resolution and refresh rate of the computer system, and then reconnect the original monitor to the PC. This solution is highly inconvenient.

More recently, CRT monitors using the PNP (Plug-and-Play) standard have been marketed. PNP allows a PC to automatically configure a resolution and refresh rate suitable for any of a variety of different monitors. In particular, some high-resolution CRTs are capable of supporting PNP. On system initialization, the PC sends out a series of clock signals on a 15-pin VGA cable to the CRT. The CRT responds by transmitting back to the PC a 128-byte data structure called EDID (Extended Display Identification Data). The EDID contains information about the configurations and refresh rates supported by the CRT, as defined by VESA (Video Electronics Standards Association) of San Jose, Calif., USA in its "Display Data Channel Standard" dated 1996. Software in the PC reads the configuration information in the 128-byte EDID, and calculates the minimum and maximum vertical refresh rate. From the refresh rate and the current resolution desired by the user, and according to the capabilities of the graphics controller hardware, the active refresh rate can be calculated or selected by the display driver using the appropriate video BIOS function. The correct refresh rate is thus programmed when both the PC and the CRT have hardware and/or software to support auto-configuration of monitors using PNP.

Nevertheless, PNP is a relatively recent standard, and many older CRT monitors do not support the standard. In addition, many PCs do not have the necessary hardware and/or software to support auto-configuration.

To overcome this problem, U.S. Pat. No. 6,049,316 entitled PC with Multiple Video-display Refresh-rate Configurations Using Active and Default Registers and issued on Apr. 11, 2000 discloses a graphics controller sub-system for managing multiple configurations for displays on a portable PC. The graphics controller sub-system has an active register that stores a current vertical refresh rate, a vertical synchronization timer that generates a vertical synchronization pulse with a period corresponding to the current vertical refresh rate stored in the active register, and a driving means that is coupled to the vertical synchronization timer. The driving means drives the vertical synchronization pulse to an external CRT monitor. The vertical synchronization pulse resets the external CRT monitor from a last line of pixels to a first line of pixels. The active register and the default register are hardware registers on a graphics controller chip that contains the pixel transfer means.

However, the graphics controller sub-system must be installed in the computer system, which adds to the software and hardware burden of the computer system. In addition, the user may simply omit or forget to install the graphics controller sub-system before the problem actually arises. A more convenient and efficient method for adjusting a resolution and refresh rate of a display monitor is desired.

SUMMARY OF THE INVENTION

An object of the present invention is to provide a method for readily adjusting a resolution and refresh rate of a display monitor of a computer system.

To achieve the above object, a preferred method of the present invention comprises the steps of: (a) providing a portable recording device recording a auto-run application; (b) connecting the portable recording device to the computer; (c) loading interrupt functions of BIOS (Basic Input/Output System), (d) acquiring EDID (Extended Display Identification Data) of the monitor; (e) obtaining the $35^{th}$ and $36^{th}$ bytes of the EDID; (f) finding bits in the $35^{th}$ and $36^{th}$ bytes whose value is 1; (g) finding data of resolutions and refresh rates of said bits whose value is 1; (h) constructing an array with the data; (i) determining a matching resolution and a matching refresh rate in the array; and (j) adjusting the current resolution and refresh rate of the computer system to the matching resolution and refresh rate.

Other objects, advantages and novel features of the present invention will be drawn from the following detailed description of the preferred method thereof together with the attached drawings, in which:

BRIEF DESCRIPTION OF THE DRAWINGS

FIG. 2 is a table of contents of $35^{th}$ and $36^{th}$ bytes of EDID (Extended Display Identification Data) of the display monitor of FIG. 1;

DETAILED DESCRIPTION OF THE PREFERRED EMBODIMENT

Figure 1:
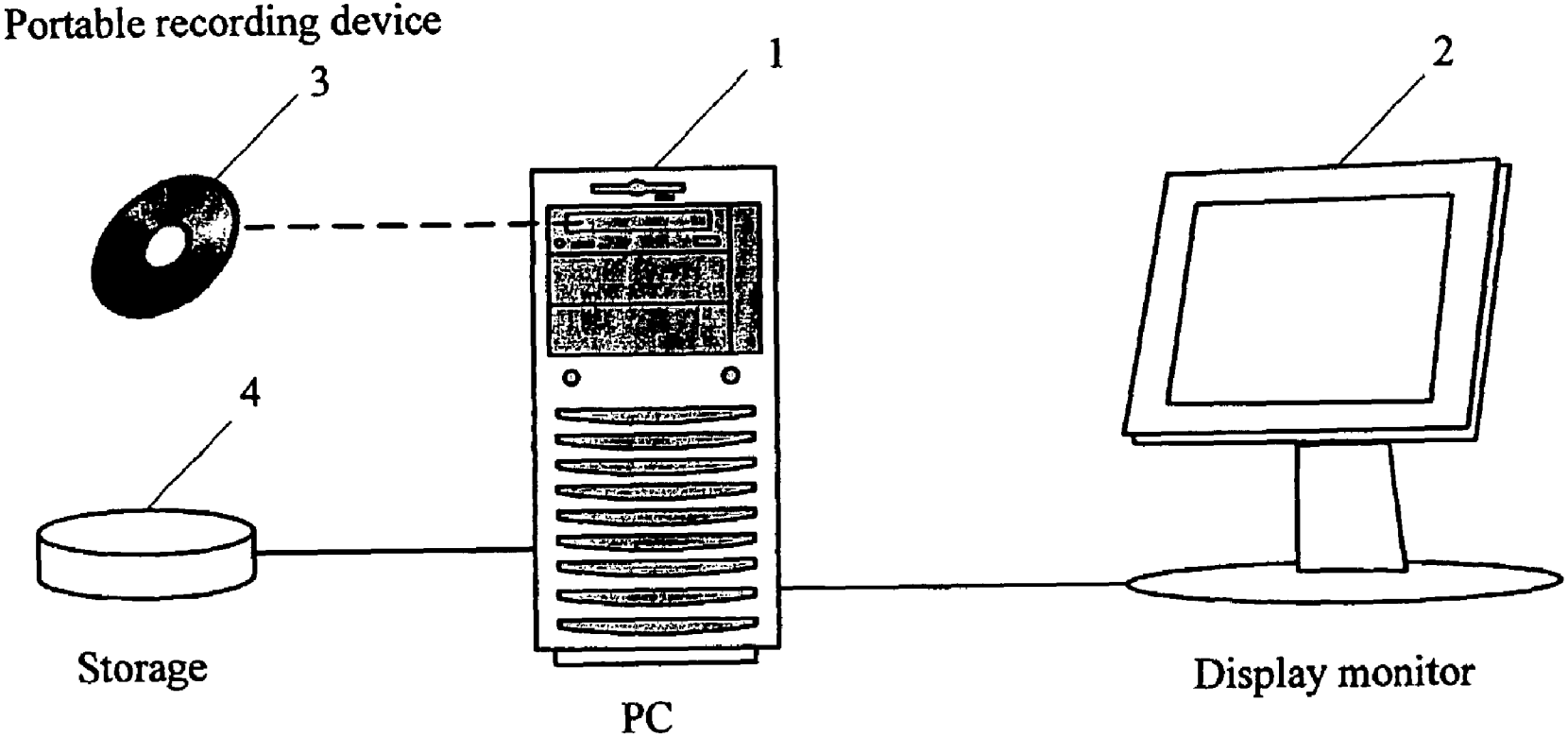
FIG. 1 is a schematic diagram of hardware infrastructure used in the preferred method for adjusting a resolution and refresh rate of a display monitor in a computer system in accordance with the present invention.

FIG. 1 is a schematic diagram of hardware infrastructure used in the preferred method for adjusting a resolution and refresh rate of a display monitor in a computer system in accordance with the present invention (hereinafter, "the method"). The hardware infrastructure comprises: a PC (Personal Computer) 1, a display monitor 2, and a portable recording device 3. The PC 1 can be a desktop computer, a laptop computer, or a server computer. The PC 1 comprises a storage 4, a VGA (Video Graphics Array) interface, one or more Input/Output interfaces (not shown), and a plurality of Input/Output devices such as a compact disk drive and/or a floppy disk drive. The Input/Output interfaces can be USB (Universal Serial Bus) interfaces, PCIs (Peripheral Component Interconnects), parallel interfaces, and/or serial interfaces. The display monitor 2 can be a CRT (Cathode-Ray Tube) monitor or an LCD (Liquid Crystal Display) monitor, either of which is connected with the PC 1 by a 15-pin VGA cable. The portable recording device 3 can be a floppy disk, a compact disk, or a USB recorder recording an auto-run application (only a compact disk is shown in FIG. 1). The storage 4 is a device to record data about resolutions and refresh rates used or generated in performing the method, such as EDID (Extended Display Identification Data) of the display monitor 2. The resolutions and refresh rates information of the display monitor 2 is recorded in the $35^{th}$ and $36^{th}$ bytes of the EDID. The storage 4 can be a memory or a hard disk of the PC 1.

FIG. 2 is a table of the contents of the $35^{th}$ and $36^{th}$ bytes of the EDID of the display monitor 2. The table comprises three columns: Byte, Bit, and Description. Each byte has eight bits, and the value of each bit is assigned with 0 or 1 in binary code. Each description corresponds to a bit, and contains data of a resolution and refresh rate of the display monitor 2. For example, 720×400@70 Hz corresponds to Bit 7 of the $35^{th}$ Byte, and 1024×768@87 Hz corresponds to Bit 4 of the $36^{th}$ Byte. In these examples, 720×400 and 1024×768 are resolutions of the display monitor 2, and 70 Hz and 87 Hz are refresh rates of the display monitor 2. If the value of the bit is 1, the description of the bit is data of a resolution and refresh rate which the display monitor 2 supports.

Figure 3:
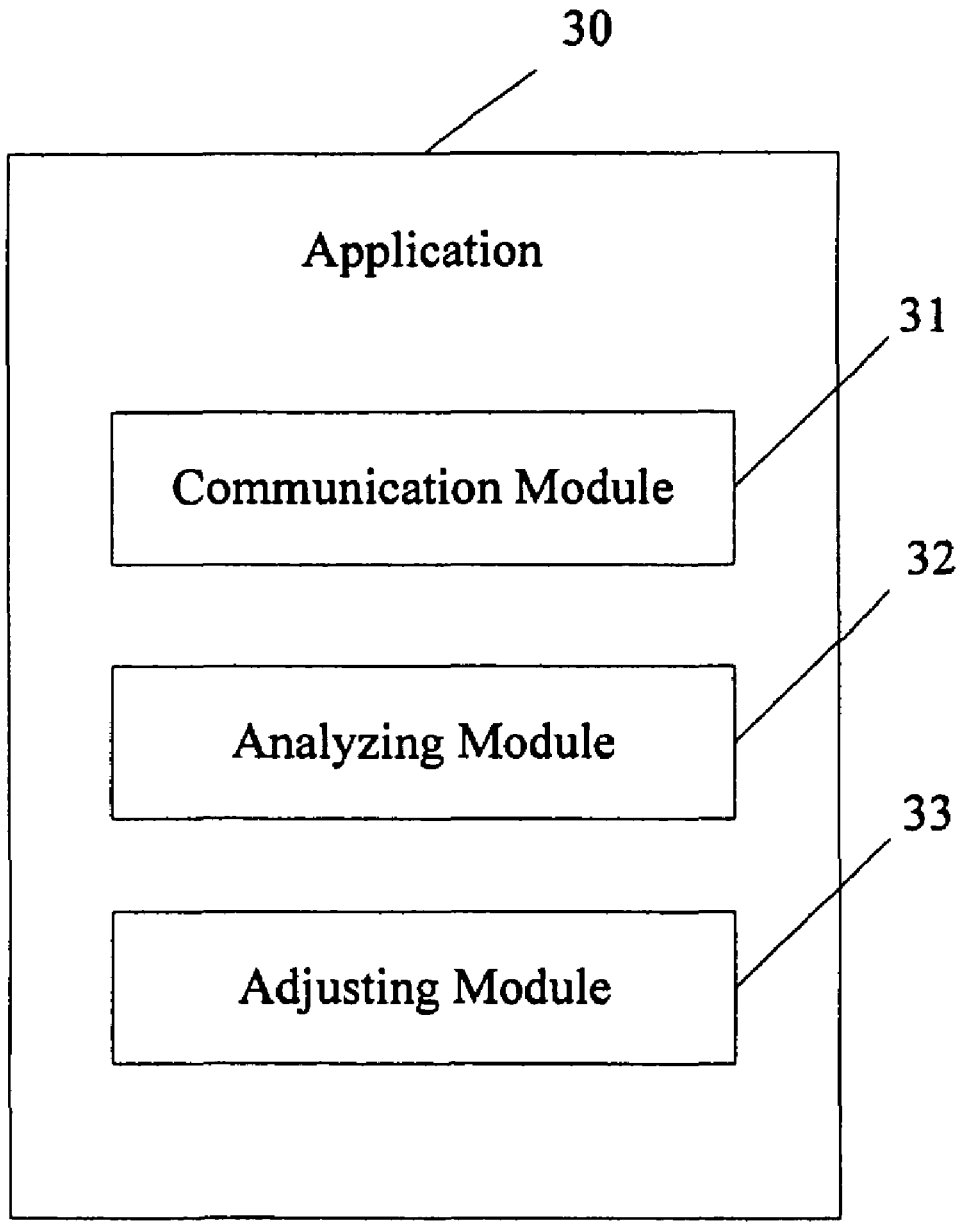
FIG. 3 is a schematic diagram of main function modules of an application recorded in a portable recording device of FIG. 1.

FIG. 3 is a schematic diagram of main function modules of an application 30 recorded in the portable recording device 3, for adjusting the resolution and refresh rate of the display monitor 2 of the computer system. The application 30 is an auto-run application, and comprises three main function modules: a communication module 31 for acquiring the EDID of the display monitor 2, an analyzing module 32 for generating a matching resolution and a matching refresh rate of the display monitor 2, and an adjusting module 33 for adjusting the current resolution and refresh rate of the computer system to the matching resolution and refresh rate.

Figure 4:
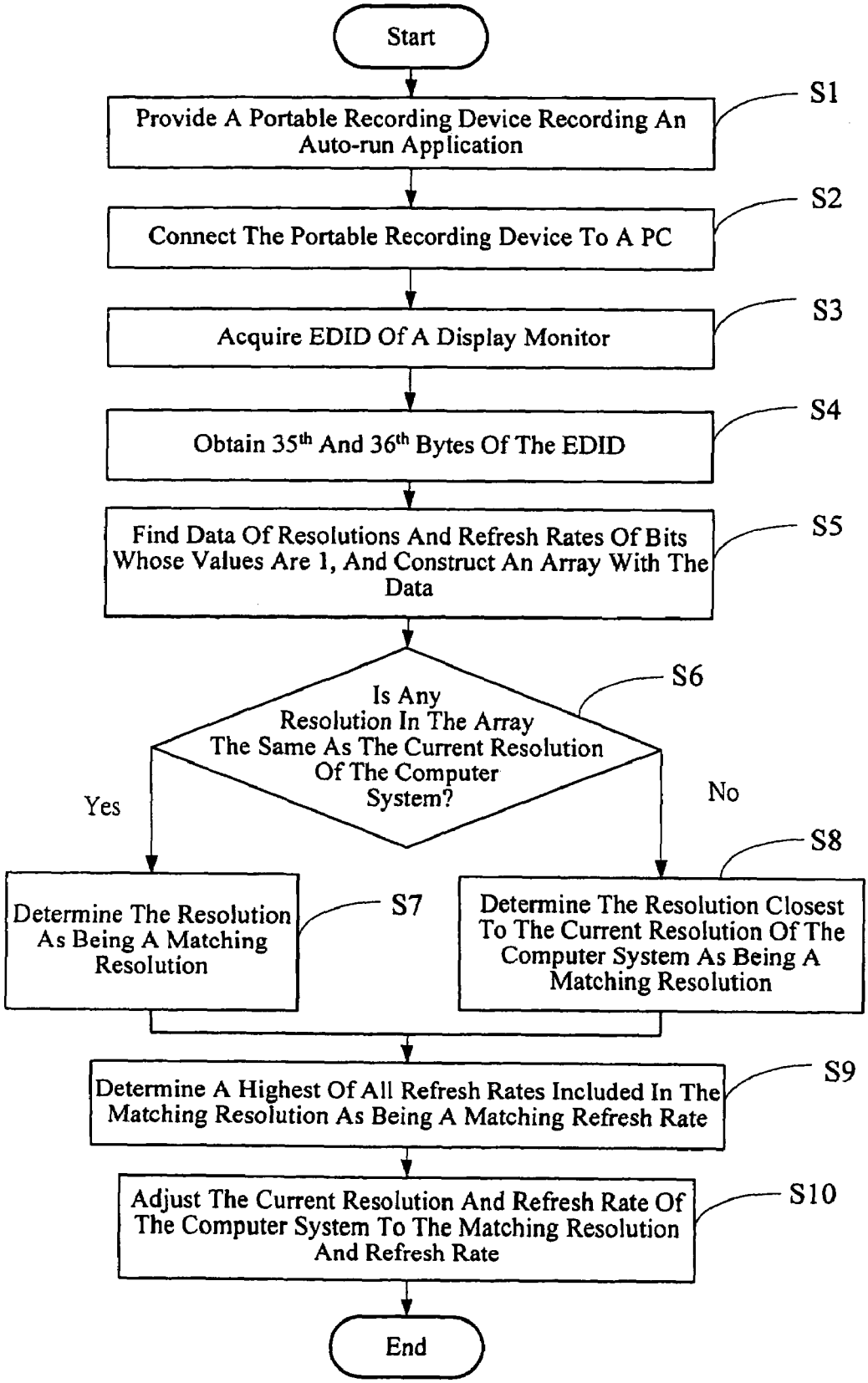
FIG. 4 is a flow chart of the preferred method for adjusting a resolution and refresh rate of a display monitor of a computer system in accordance with the present invention.

FIG. 4 is a flow chart of the preferred method for adjusting a resolution and refresh rate of the display monitor 2 of the computer system in accordance with the present invention. In step S1, a portable recording device 3 recording an auto-run application 30 is provided. The portable recording device 3 can be a floppy disk, a compact disk, or a USB recorder. In step S2, a user connects the portable recording device 3 to the PC 1. In step S3, the communication module 31 loads interrupt functions of a BIOS (Basic Input/Output System), acquires the EDID of the display monitor 2, and saves the EDID in the storage 4.

In step S4, the analyzing module 32 obtains the $35^{th}$ and $36^{th}$ bytes of the EDID. In step S5, the analyzing module 32 finds the data of resolutions and refresh rates of the bits in the $35^{th}$ and $36^{th}$ bytes whose values are 1, and constructs an array with the data. In step S6, the analyzing module 32 compares the resolutions specified in the array of bits with the current resolution of the computer system, and determines whether one of the resolutions is the same as the current resolution of the computer system. If one of the resolutions is the same as the current resolution of the computer system, in step S7, the analyzing module 32 determines the resolution as being a matching resolution of the display monitor 2. In contrast, in step S8, if there is no resolution in the array of bits that is the same as the current resolution of the computer system, the analyzing module 32 determines the resolution that is the closest to the current resolution as being a matching resolution of the display monitor 2. In step S9, the analyzing module 32 compares all refresh rates included in the matching resolution, and determines the highest refresh rate of all the refresh rates as being a matching refresh rate of the display monitor 2. In step S10, the adjusting module 33 adjusts the current resolution and refresh rate of the computer system to the matching resolution and refresh rate.

Although the present invention has been specifically described on the basis of a preferred embodiment and preferred method, the invention is not to be construed as being limited thereto. Various changes or modifications may be made to the embodiment and method without departing from the scope and spirit of the invention.

What is claimed is:

1. A method for adjusting a resolution and refresh rate of a display monitor of a computer system, the computer system including a computer and the display monitor connected with the computer, the method comprising the steps of:

providing a portable recording device recording an auto-run application;

connecting the portable recording device to the computer;

loading interrupt functions of a BIOS (Basic Input/Output System), and acquiring EDID (Extended Display Identification Data) of the monitor;

generating a matching resolution and a matching refresh rate of the display monitor; and adjusting the current resolution and refresh rate of the computer system to the matching resolution and refresh rate.

2. The method of claim 1, wherein the portable recording device is a floppy disk, a compact disk, or a USB (Universal Serial Bus) recorder.

3. The method of claim 1, wherein the step of generating a matching resolution and a matching refresh rate of the display monitor comprises the steps of:

acquiring data recording resolutions and refresh rates in the EDID; and determining a matching resolution and a matching refresh rate of the display monitor based on the acquired data.

4. The method of claim 3, wherein the step of acquiring data recording resolutions and refresh rates in the EDID comprises the steps of:

obtaining $35^{th}$ and $36^{th}$ bytes of the EDID;

finding one or more bits in the $35^{th}$ and $36^{th}$ bytes whose value is 1;

finding data of resolutions and refresh rates of said bits whose value is 1; and constructing an array with the found data.

5. The method of claim 4, wherein the step of determining a matching resolution and a matching refresh rate of the display monitor based on the acquired data comprises the steps of:

comparing one or more resolutions in the array with the current resolution of the computer system;

determining a resolution as being a matching resolution;

comparing all refresh rates of the matching resolution; and determining a matching refresh rate based on the highest refresh rate of the matching resolution.

6. The method of claim 5, wherein the step of determining a resolution as being a matching resolution comprises the steps of:

determining a resolution as being a matching resolution, if the resolution is the same as the resolution of the computer system; or determining a resolution that is closest to the resolution of the computer system as being a matching resolution, if no resolution is the same as the resolution of the computer system.

7. A method for adjusting a resolution and refresh rate of a display monitor of a computer system, comprising the steps of:

auto-running a predetermined application in said computer system in case that said display monitor connects to said computer system;

retrieving information of extended display identification data (EDID) of said display monitor via a basic input/output system (BIOS) function of said computer system;

generating a matching resolution and a matching refresh rate with said display monitor based on said information of EDID; and adjusting corresponding data in said computer system to said matching resolution and refresh rate of said display monitor.

8. A method for adjusting a resolution and refresh rate of a display monitor of a computer system, comprising the steps of:

installing and running an auto-run application in said computer system in case that said display monitor connects with said computer system;

retrieving information of extended display identification data (EDID) of said display monitor;

constructing available resolutions and refresh rates of said display monitor based on said information of EDID;

matching said available resolutions said display monitor with current data in said computer system;

selecting one of said available refresh rates of said display monitor based on a matched resolution of said display monitor from said matching step; and replacing said current data in said computer system by said matched resolution and said selected one of said available refresh rates of said display monitor in order to successfully use said display monitor.

9. The method of claim 8, wherein said selected one of said available refresh rates of said display monitor is the highest one among said available refresh rates corresponding to said matched resolution of said display monitor in said selecting step.

* * * * *